US011844382B2

(12) United States Patent
Ali

(10) Patent No.: US 11,844,382 B2
(45) Date of Patent: Dec. 19, 2023

(54) AUTOMATED FACE SHIELD ASSEMBLY

(71) Applicant: Nazar Ali, Bellevue, WA (US)

(72) Inventor: Nazar Ali, Bellevue, WA (US)

( * ) Notice: Subject to any disclaimer, the term of this patent is extended or adjusted under 35 U.S.C. 154(b) by 235 days.

(21) Appl. No.: 17/323,090

(22) Filed: May 18, 2021

(65) Prior Publication Data

US 2022/0369735 A1 Nov. 24, 2022

(51) Int. Cl.
*A41D 13/11* (2006.01)

(52) U.S. Cl.
CPC ..... *A41D 13/1184* (2013.01); *A41D 13/1161* (2013.01)

(58) Field of Classification Search
CPC .. A41D 13/1161; A41D 13/1184; A42B 3/22; A42B 3/221; A42B 3/225; F21V 23/0442; F21V 23/0471; A61L 2209/111; A63F 2009/2447; B25J 13/086
See application file for complete search history.

(56) References Cited

U.S. PATENT DOCUMENTS 4,546,498 A * 10/1985 Fantin ..... A42B 3/224 2/10
4,679,255 A 7/1987 Kuhlman
4,916,753 A 4/1990 Khacdung
4,920,576 A 5/1990 Landis
4,986,282 A * 1/1991 Stackhouse ..... A61F 9/02 128/857
5,016,293 A * 5/1991 Lickle ..... A61F 9/028 2/435
D326,932 S 6/1992 Millar
5,337,419 A * 8/1994 Russell ..... A61F 9/02 128/857
5,440,760 A 8/1995 Highsmith
(Continued)

FOREIGN PATENT DOCUMENTS

FR 2610484 A1 * 8/1988 ..... A42B 3/02
WO WO9636303 11/1996

OTHER PUBLICATIONS

Rameet Singh Sachar and Hridesh Gilani, "Smart Face Shield", Jul. 18, 2020, Hackster.io, https://www.hackster.io/353848/smart-face-shield-61eb08 (Year: 2020).*
(Continued)

*Primary Examiner* — Clinton T Ostrup
*Assistant Examiner* — Brianna T. Duckworth

(57) ABSTRACT

An automated face shield assembly includes a band that is wearable around a user's head. A pair of actuators is coupled to the band and a face shield is coupled to the pair of actuators. The face shield covers the user's face when the actuators are actuated into a first condition. The face shield exposes the user's face when the actuators are actuated into a second condition. Moreover, the face shield is comprised of a fluid impermeable material to inhibit airborne transmission of infectious diseases between the user and another person. A pair of motion sensors is each coupled to a respective one of the actuators. The actuators are actuated into the first condition when the motion sensors sense motion to cover the user's face when the person approaches the user. Additionally, the actuators are actuated into the second condition when the motion sensors do not sense motion.

7 Claims, 6 Drawing Sheets

(56) References Cited

U.S. PATENT DOCUMENTS

| | | | | |
|---|---|---|---|---|
| 7,080,414 | B1 * | 7/2006 | Montero | A42B 3/224 340/432 |
| 2015/0181972 | A1 * | 7/2015 | Djerassi | A42B 3/22 2/424 |
| 2022/0007775 | A1 * | 1/2022 | Matulis | A42B 3/224 |
| 2022/0008763 | A1 * | 1/2022 | Saleh | H04W 4/38 |

OTHER PUBLICATIONS

Rameet Singh Sachar and Hridesh Gilani, "Smart Social Distancing Face Shield", Jul. 18, 2020, Youtube.com (also embedded in Hackster.io webpage), https://www.youtube.com/watch?v=2UgwspnVoWw (Year: 2020).*

* cited by examiner

AUTOMATED FACE SHIELD ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to face shield device and more particularly pertains to a new face shield device for automatically lowering a face shield over a user's face. The device includes a pair of actuators and a pair of motion sensors. The actuators are attached to the face shield and the actuators lower the face shield when the motions sensors sense motion. Conversely, the actuators raise the face shield when the motion sensors do not sense motion.

(2) Description of Related Art Including Information Disclosed Under 37 CFR 1.97 and 1.98

The prior art relates to face shield devices including a variety of helmet devices that each has a face shield and an opening mechanism for automatically opening or closing the face shield on a helmet. The prior art discloses a variety of face shield devices that include a head band and a face shield which extends downwardly in front of user's face when the head band is worn. In no instance does the prior art disclose a face shield device that includes a head band, a pair of actuators coupled to the head band and a face shield coupled to the actuators for automatically lifting and lowering the face shield.

BRIEF SUMMARY OF THE INVENTION

An embodiment of the disclosure meets the needs presented above by generally comprising a band that is wearable around a user's head. A pair of actuators is each is coupled to the band and a face shield is coupled to each of the actuators. The face shield covers the user's face when the actuators are actuated into a first condition. The face shield exposes the user's face when the actuators are actuated into a second condition. Moreover, the face shield is comprised of a fluid impermeable material to inhibit airborne transmission of infectious diseases between the user and another person. A pair of motion sensors is each coupled to a respective one of the actuators. The actuators are actuated into the first condition when the motion sensors sense motion to cover the user's face when the person approaches the user. Additionally, the actuators are actuated into the second condition when the motion sensors do not sense motion.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
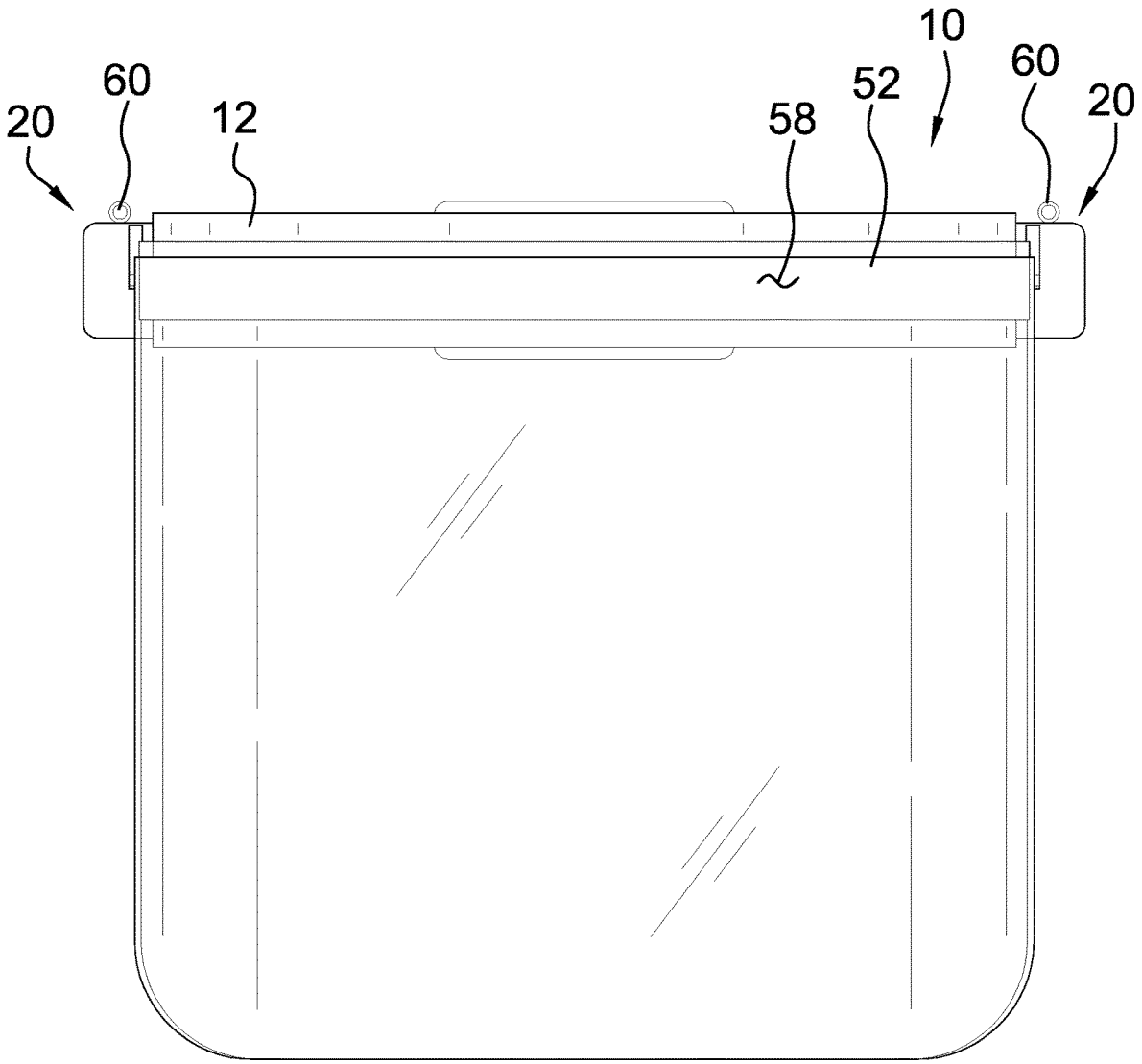
FIG. 1 is a front view of an automated face shield assembly according to an embodiment of the disclosure.
Figure 2:
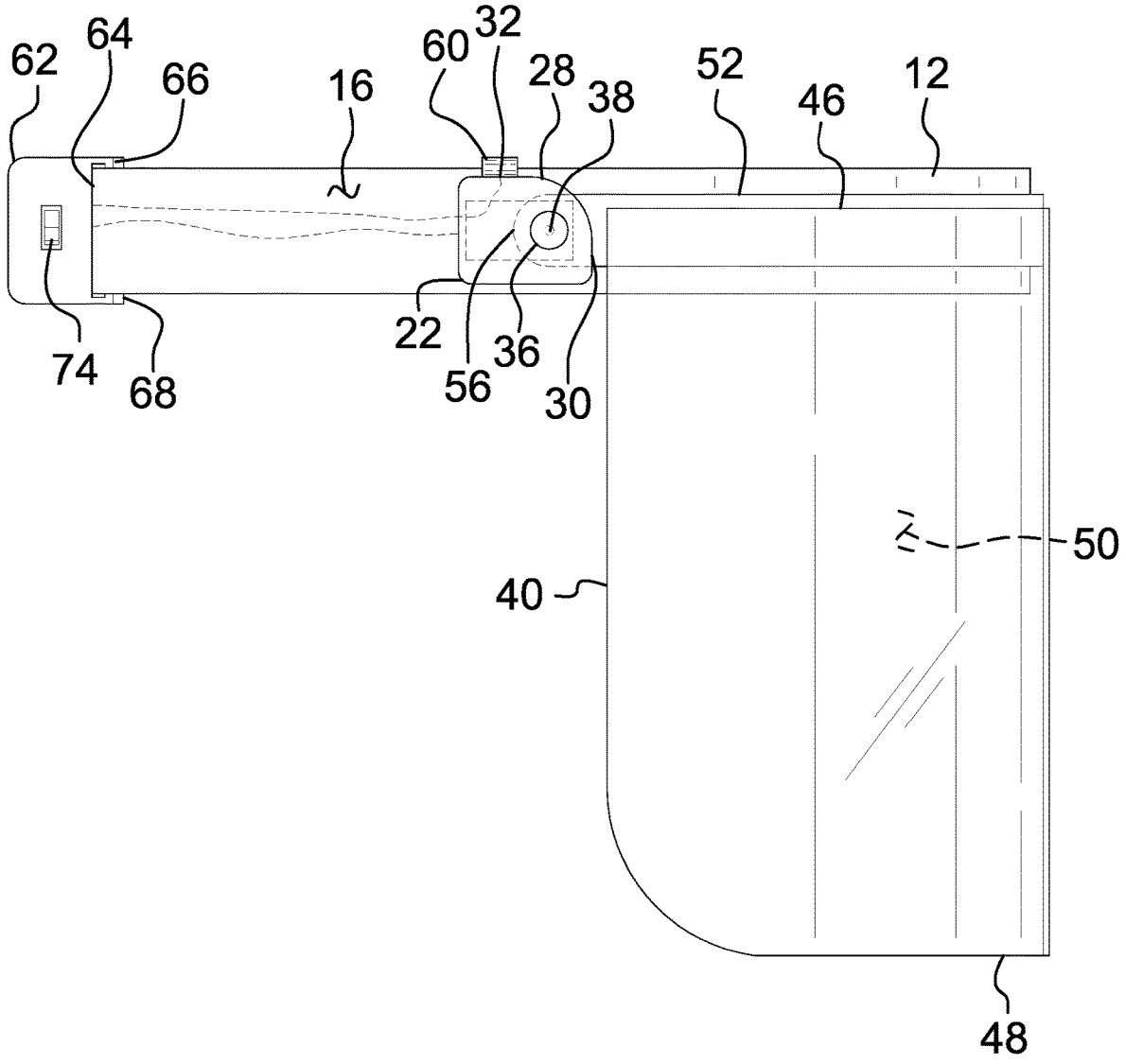
FIG. 2 is a right side phantom view of an embodiment of the disclosure.
Figure 3:
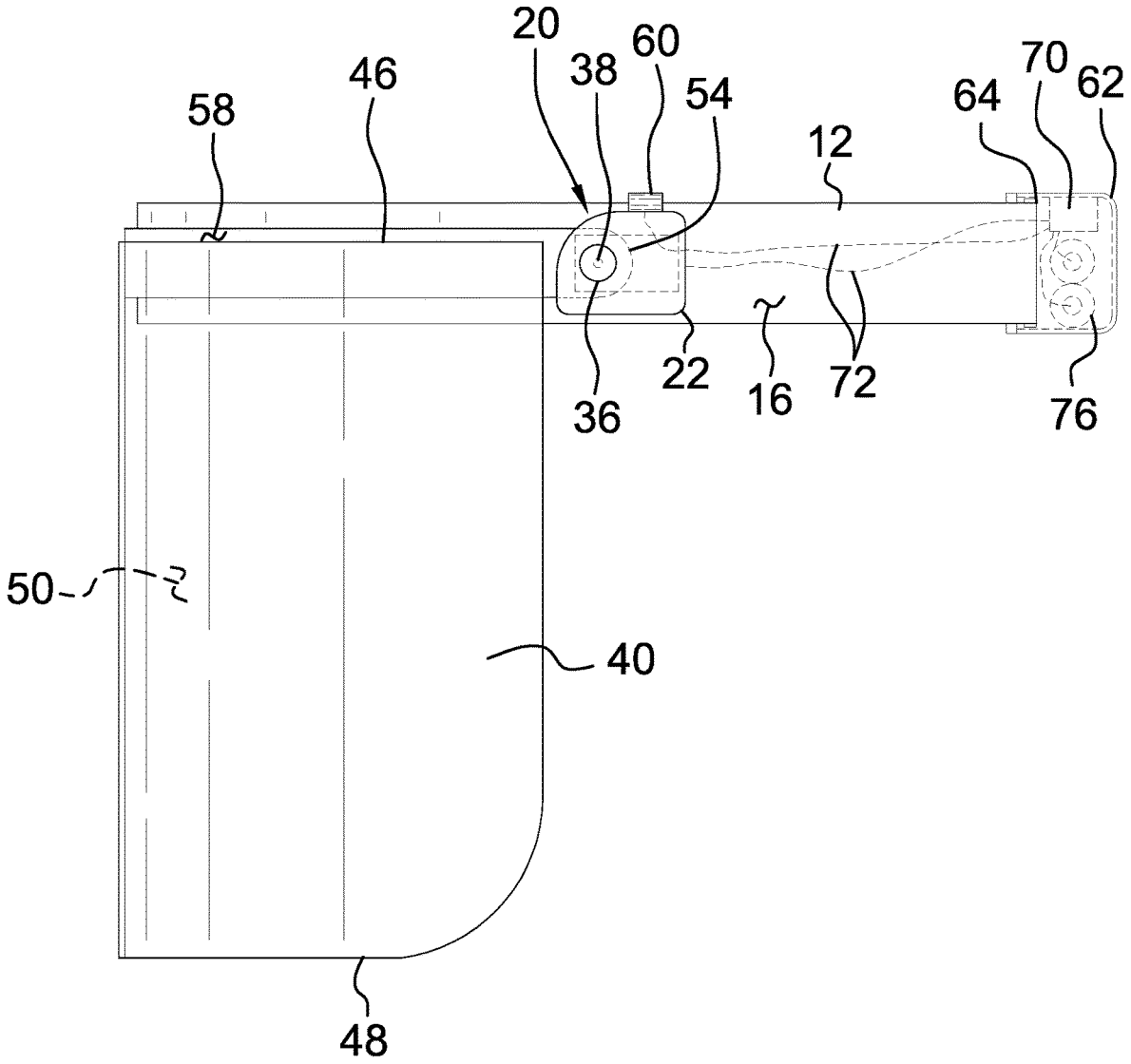
FIG. 3 is a left side phantom view of an embodiment of the disclosure.
Figure 4:
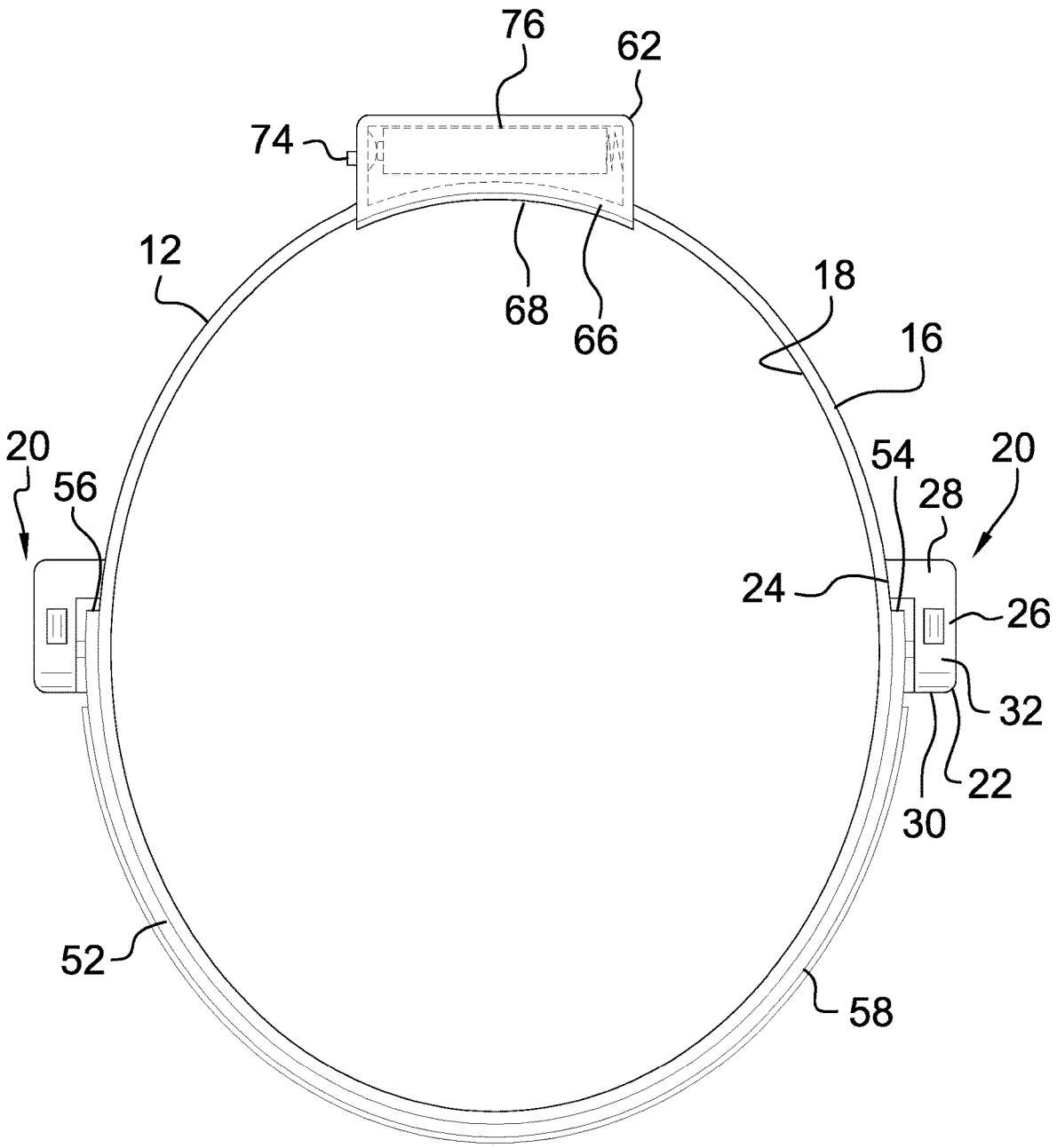
FIG. 4 is a bottom phantom view of an embodiment of the disclosure.
Figure 5:
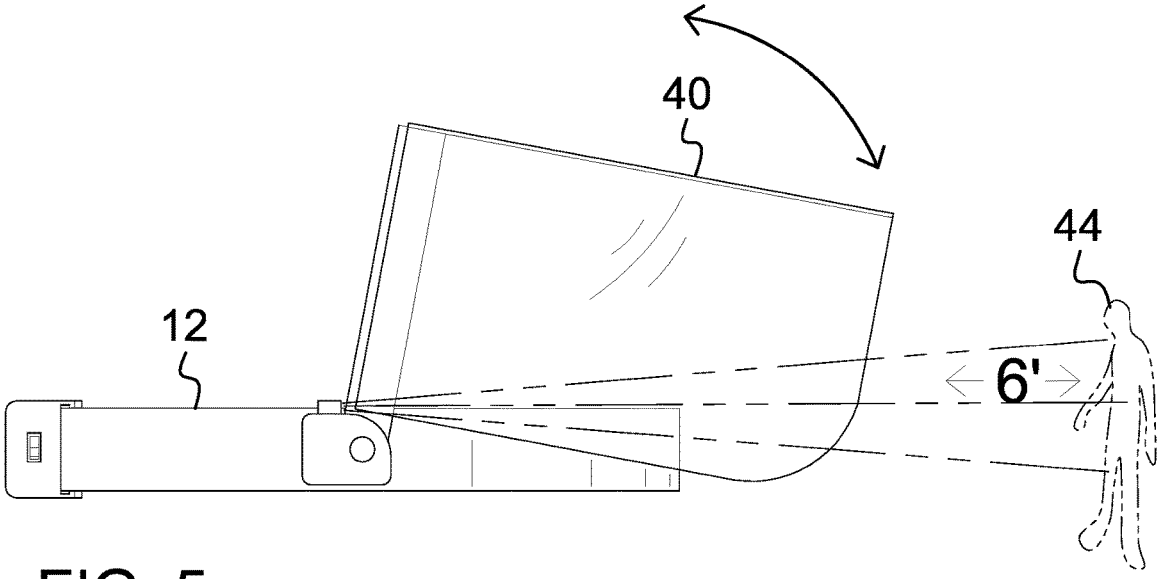
FIG. 5 is a perspective in-use view of an embodiment of the disclosure showing a face shield being lifted.
Figure 6:
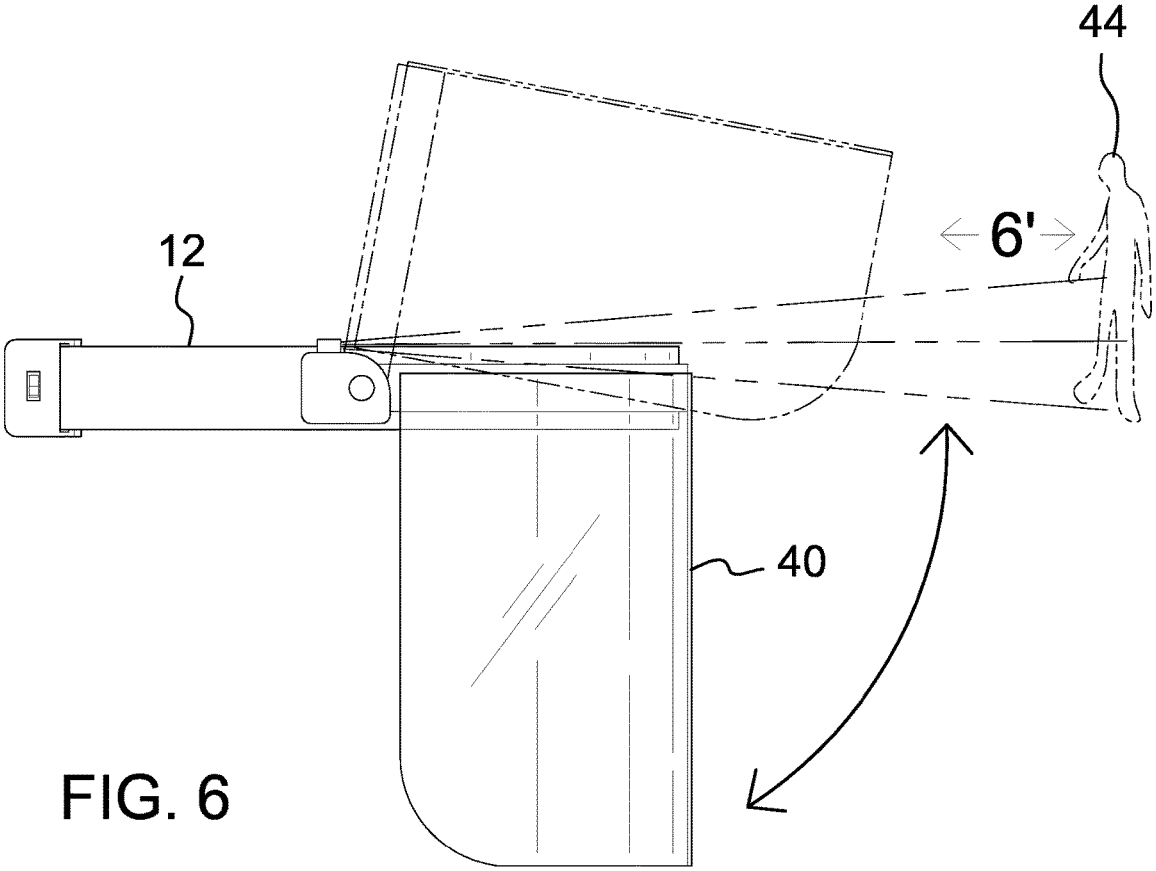
FIG. 6 is a perspective in-use view of an embodiment of the disclosure showing a face shield being lowered.
Figure 7:
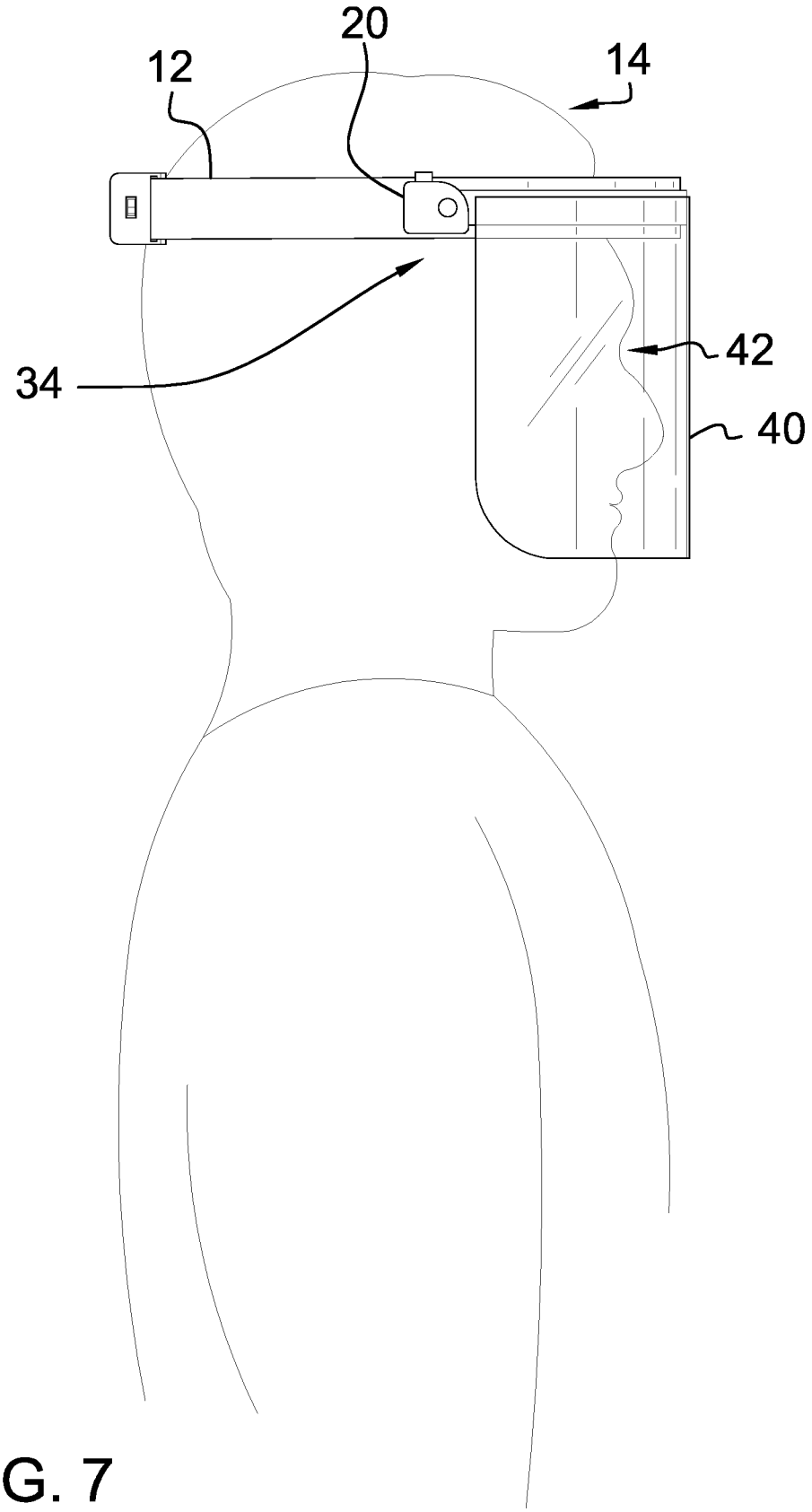
FIG. 7 is a perspective in-use view of an embodiment of the disclosure showing a face shield being worn.

With reference now to the drawings, and in particular to FIGS. 1 through 7 thereof, a new face shield device embodying the principles and concepts of an embodiment of the disclosure and generally designated by the reference numeral 10 will be described.

As best illustrated in FIGS. 1 through 7, the automated face shield assembly 10 generally comprises a band 12 that is wearable around a user's head 14. The band 12 is comprised of an elastomeric material to accommodate a variety of sizes of heads, and the band 12 has an outer surface 16 and an inner surface 18. A pair of actuators 20 is each coupled to the band 12 and each of the actuators 20 is actuatable in a first condition or a second condition when the actuators 20 are turned on.

Each of the actuators 20 comprises a motor housing 22 has a first wall 24, a second wall 26 and a perimeter wall 28 extending between the first wall 24 and the second wall 26, and the perimeter wall 28 has a front side 30 and a top side 32. Each of the front side 30 and the top side 32 of the perimeter wall 28 is substantially open, and the first wall 24 is coupled to the outer surface 16 of the band 12. Additionally, the motor housing 22 associated with each of the actuators 20 is positioned on opposite sides of the band 12 with respect to each other. In this way the motor housing 22 associated with each of the actuators 20 is aligned with a respective one of the user's temples 34 when the band 12 is worn on the user's head 14. Each of the actuators 20 includes a motor 36 that is positioned inside the motor housing 22. The motor 36 rotating in a first direction or a second direction, and the motor 36 has a drive shaft 38 which extends through the first wall 24 and the second wall 26 of the motor housing 22. The motor 36 may be a two direction electric motor or the like.

A face shield 40 is provided and the face shield 40 is coupled to each of the actuators 20. The face shield 40 extends downwardly from the band 12 when the actuators 20 are actuated into the first condition to cover the user's face 42. Conversely, the face shield 40 extends forwardly from the band 12 when the actuators 20 are actuated into the second condition to expose the user's face 42. The face shield 40 is comprised of a translucent material to facilitate the user to see when the face shield 40 is lowered. Additionally, the face shield 40 is comprised of a fluid impermeable material to inhibit airborne transmission of infectious diseases between the user and the person 44 when the face shield 40 is lowered. The face shield 40 has a top edge 46, a bottom edge 48 and a rear surface 50 extending between the top edge 46 and the bottom edge 48, and the rear surface 50 is concavely arcuate.

A member 52 is provided that has a primary end 54, a secondary end 56 and a front surface 58 extending therebetween, and the member 52 is curved between the primary end 54 and the secondary end 56. Each of the primary end 54 and the secondary end 56 extends into the front side 30 of the perimeter wall 28 of the motor housing 22 associated with a respective one of the actuators 20. The drive shaft 38 associated with each of the actuators 20 engages the member 52. The member 52 is oriented to extend along a line that is aligned with the band 12 when the motor 36 associated with each of the actuators 20 rotates in the first direction. Conversely, the member 52 is oriented to extend along a line that is oriented perpendicular to the band 12 when the motor 36 associated with each of the actuators 20 rotates in the second direction such that the member 52 extends upwardly from the band 12.

The rear surface 50 of the face shield 40 is coupled to the front surface 58 of member 52. Additionally, the top edge 46 of the face shield 40 extends substantially between the motor housing 22 associated with each of the actuators 20. The face shield 40 lies on a vertical plane when the motor 36 associated with each of the actuators 20 rotates in the first direction. In this way the face shield 40 is positioned to cover the user's face 42. Conversely, the face shield 40 lies on a horizontal plane when the motor 36 associated with each of the actuators 20 rotates in the second direction. In this way the face shield 40 is positioned to expose the user's face 42.

A pair of motion sensors 60 is each coupled to a respective one of the actuators 20 to sense motion within a trigger distance of the respective actuator 20. Each of the motion sensors 60 may comprise an electronic motion sensor that has a maximum effective range of less than 10.0 feet. Each of the actuators 20 is actuated into the second condition when the motion sensors 60 sense motion to cover the user's face 42 when the person 44 approaches the user. Conversely, each of the actuators 20 is actuated into the first condition when the motion sensors 60 do not sense motion after a minimum duration of time to expose the user's face 42. Each of the motion sensors 60 is positioned on the top side 32 of the perimeter wall 28 of the motor housing 22 associated with the respective actuator 20. Additionally, each of the motion sensors 60 is oriented to sense motion in front of the user when the band 12 is worn on the user's head 14.

A control housing 62 is coupled to the band 12 and the control housing 62 has a band slot 64 extending laterally through the control housing 62. The band 12 extends through the band slot 64 such that a forward wall 66 of the control housing 62 abuts the user's head 14 when the band 12 is worn. A pad 68 is coupled to the forward wall 66 of the control housing 62 such that the pad 68 abuts the user's head 14 when the band 12 is worn around the user's head 14. The pad 68 is comprised of a resiliently compressible material to enhance comfort for the user.

A control circuit 70 is positioned in the control housing 62, the control circuit 70 is electrically coupled to each of the motion sensors 60 and the control circuit 70 receives a lower input and a lift input. The control circuit 70 receives the lower input when the motion sensors 60 sense motion. Additionally, the control circuit 70 receives the lift input when the motion sensors 60 do not sense motion for a pre-determined duration of time. The pre-determined duration of time may range between approximately 5.0 seconds and 10.0 seconds. The control circuit 70 is electrically coupled to the motor 36 associated with each of the actuators 20. The control circuit 70 actuates the motor 36 associated with each of the actuators 20 to rotate in the first direction when the control circuit 70 receives the lower input. Conversely, the control circuit 70 actuates the motor 36 in each of the actuators 20 to rotate in the second direction when the control circuit 70 receives the lift input.

A plurality of conductors 72 is each is integrated into the band 12 and each of the conductors 72 is comprised of an electrically conductive material. Moreover, each of the conductors 72 is electrically coupled between the control circuit 70 and a respective one of the motor 36 associated with each of the actuators 20 and a respective one of the motion sensors 60. A power switch 74 is slidably integrated into the control housing 62, the power switch 74 is electrically coupled to the control circuit 70 and the power switch 74 turns the control circuit 70 on and off. A power supply 76 is positioned in the control housing 62, the power supply 76 is electrically coupled to the control circuit 70 and the power supply 76 comprises at least one battery.

In use, the band 12 is worn around the user's head 14 and the power switch 74 is manipulated to turn on the control circuit 70. The face shield 40 is raised when the motion sensors 60 do not sense motion in front of the user. Conversely, the face shield 40 is lowered when the motion sensors 60 do sense motion in front of the user. In this way the face shield 40 can serve to inhibit airborne transmission of infectious diseases between the user and the person 44 that approaches the user. Moreover, the user does not have to remember 52 to lower the face shield 40 for adhering to mask mandates associated with a global pandemic or the like. The user can enjoy the freedom of breathing freely when the motion sensors 60 do not sense motion in front of the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An automated face shield assembly which automatically lowers a face shield on a user when a person approaches the user thereby inhibiting airborne transmission of infectious diseases, said assembly comprising:

a band being wearable around a user's head, said band being comprised of an elastomeric material wherein said band is configured to accommodate a variety of sizes of heads;

a pair of actuators, each of said actuators being coupled to said band, each of said actuators being actuatable in a first condition or a second condition when said actuators are turned on;

a face shield being coupled to said actuators, said face shield extending downwardly from said band when said actuators are actuated into said first condition wherein said face shield is configured to cover the user's face, said face shield extending forwardly from said band when said actuators are actuated into said second condition wherein said face shield is configured to expose the user's face, said face shield being comprised of a translucent material wherein said face shield is configured to facilitate the user to see when said face shield is lowered, said face shield being comprised of a fluid impermeable material wherein said face shield is configured to inhibit airborne transmission of infectious diseases between the user and another person; and a pair of motion sensors, each of said motion sensors being coupled to a respective one of said actuators wherein each of said motion sensors is configured to sense motion within a trigger distance of said respective actuator, each of said actuators being actuated into said second condition when said motion sensors sense motion wherein said face shield is configured to cover the user's face when the person approaches the user, each of said actuators being actuated into said first condition when said motion sensors do not sense motion after a minimum duration of time wherein said face shield is configured to expose the user's face;

wherein said band has an outer surface and an inner surface; and wherein each of said actuators comprises:

a motor housing having a first wall, a second wall and a perimeter wall extending between said first wall and said second wall, said perimeter wall having a front side and a top side, each of said front side and said top side of said perimeter wall being partially open, said first wall being coupled to said outer surface of said band, said motor housing associated with each of said actuators being positioned on opposite sides of said hand with respect to each other wherein said motor housing associated with each of said actuators is configured to be aligned with a respective one of the user's temples when said band is worn on the user's head; and a motor being positioned inside said motor housing, said motor rotating in a first direction or a second direction, said motor having a drive shaft extending through said first wall and said second wall of said motor housing.

2. The assembly according to claim 1, wherein:

said face shield has a top edge, a bottom edge and a rear surface extending between said top edge and said bottom edge, said rear surface being concavely arcuate; and said assembly includes a member having a primary end, a secondary end and a front surface extending therebetween, said member being curved between said primary end and said secondary end, each of said primary end and said secondary end extending into said front side of said perimeter wall of said motor housing associated with a respective one of said actuators, said drive shaft associated with each of said actuators engaging said member.

3. The assembly according to claim 2, wherein said member is oriented to extend along a line being aligned with said band when said motor associated with each of said actuators rotates in said first direction, said member being oriented to extend along a line being oriented perpendicular to said band when said motor associated with each of said actuators rotates in said second direction having said member extending upwardly from said band.

4. The assembly according to claim 3, wherein said rear surface of said face shield is coupled to said front surface of said member such that said top edge of said face shield extends substantially between said motor housing associated with each of said actuators, said face shield lying on a vertical plane when said motor associated with each of said actuators rotates in said first direction wherein said face shield is configured to cover the user's face, said face shield lying on a horizontal plane when said motor associated with each of said actuators rotates in said second direction wherein said face shield is configured to expose the user's face.

5. The assembly according to claim 1, further comprising:

a control housing being coupled to said band, said control housing having a band slot extending laterally through said control housing, said band extending through said band slot; and a pad being coupled to said forward wall of said housing wherein said pad is configured to abut the user's head when said band is worn around the user's head, said pad being comprised of a resiliently compressible material wherein said pad is configured to enhance comfort for the user.

6. An automated face shield assembly which automatically lowers a face shield on a user when a person approaches the user thereby inhibiting airborne transmission of infectious diseases, said assembly comprising:

a band being wearable around a user's head, said band being comprised of an elastomeric material wherein said band is configured to accommodate a variety of sizes of heads;

a pair of actuators, each of said actuators being coupled to said band, each of said actuators being actuatable in a first condition or a second condition when said actuators are turned on;

a face shield being coupled to said actuators, said face shield extending downwardly from said band when said actuators are actuated into said first condition wherein said face shield is configured to cover the user's face, said face shield extending forwardly from said band when said actuators are actuated into said second condition wherein said face shield is configured to expose the user's face, said face shield being comprised of a translucent material wherein said face shield is configured to facilitate the user to see when said face shield is lowered, said face shield being comprised of a fluid impermeable material wherein said face shield is configured to inhibit airborne transmission of infectious diseases between the user and another person;

a pair of motion sensors, each of said motion sensors being coupled to a respective one of said actuators wherein each of said motion sensors is configured to sense motion within a trigger distance of said respective actuator, each of said actuators being actuated into said second condition when said motion sensors sense motion wherein said face shield is configured to cover the user's face when the person approaches the user, each of said actuators being actuated into said first condition when said motion sensors do not sense motion after a minimum duration of time wherein said face shield is configured to expose the user's face;

a control housing being coupled to said band, said control housing having a band slot extending laterally through said control housing, said band extending through said band slot;

a pad being coupled to said forward wall of said housing wherein said pad is configured to abut the user's head when said band is worn around the user's head, said pad being comprised of a resiliently compressible material wherein said pad is configured to enhance comfort for the use;

wherein each of said actuators comprises:

a motor housing having a first wall, a second wall and a perimeter wall extending between said first wall and said second wall, said perimeter wall having a front side and a top side, each of said front side and said top side of said perimeter wall being partially open, said first wall being coupled to said outer surface of said band, said motor housing associated with each of said actuators being positioned on opposite sides of said band with respect to each other wherein said motor housing associated with each of said actuators is configured to be aligned with a respective one of the user's temples when said band is worn on the user's head; and a motor being positioned inside said motor housing, said motor rotating in a first direction or a second direction, said motor having a drive shaft extending through said first wall and said second wall of said motor housing; and said assembly includes a control circuit being positioned in said control housing, said control circuit being electrically coupled to each of said motion sensors, said control circuit receiving a lower input and a lift input, said control circuit receiving said lower input when said motion sensors sense motion, said control circuit receiving said lift input when said motion sensors do not sense motion for a pre-determined duration of time, said control circuit being electrically coupled to said motor associated with each of said actuators, said control circuit actuating said motor associated with each of said actuators to rotate in said first direction when said control circuit receives said lower input, said control circuit actuating said motor in each of said actuators to rotate in said second direction when said control circuit receives said lift input.

7. An automated face shield assembly which automatically lowers a face shield on a user when a person approaches the user thereby inhibiting airborne transmission of infectious diseases, said assembly comprising:

a band being wearable around a user's head, said band being comprised of an elastomeric material wherein said band is configured to accommodate a variety of sizes of heads, said band having an outer surface and an inner surface;

a pair of actuators, each of said actuators being coupled to said band, each of said actuators being actuatable in a first condition or a second condition when said actuators are turned on, each of said actuators comprising:

a motor housing having a first wall, a second wall and a perimeter wall extending between said first wall and said second wall, said perimeter wall having a front side and a top side, each of said front side and said top side of said perimeter wall being partially open, said first wall being coupled to said outer surface of said band, said motor housing associated with each of said actuators being positioned on opposite sides of said band with respect to each other wherein said motor housing associated with each of said actuators is configured to be aligned with a respective one of the user's temples when said band is worn on the user's head; and a motor being positioned inside said motor housing, said motor rotating in a first direction or a second direction, said motor having a drive shaft extending through said first wall and said second wall of said motor housing;

a face shield being coupled to said actuators, said face shield extending downwardly from said band when said actuators are actuated into said first condition wherein said face shield is configured to cover the user's face, said face shield extending forwardly from said band when said actuators are actuated into said second condition wherein said face shield is configured to expose the user's face, said face shield being comprised of a translucent material wherein said face shield is configured to facilitate the user to see when said face shield is lowered, said face shield being comprised of a fluid impermeable material wherein said face shield is configured to inhibit airborne transmission of infectious diseases between the user and another person, said face shield having a top edge, a bottom edge and a rear surface extending between said top edge and said bottom edge, said rear surface being concavely arcuate;

a member having a primary end, a secondary end and a front surface extending therebetween, said member being curved between said primary end and said secondary end, each of said primary end and said secondary end extending into said front side of said perimeter wall of said motor housing associated with a respective one of said actuators, said drive shaft associated with each of said actuators engaging said member, said member being oriented to extend along a line being aligned with said band when said motor associated with each of said actuators rotates in said first direction, said member being oriented to extend along a line being oriented perpendicular to said band when said motor associated with each of said actuators rotates in said second direction having said member extending upwardly from said band, said rear surface of said face shield being coupled to said front surface of said member such that said top edge of said face shield extends substantially between said motor housing associated with each of said actuators, said face shield lying on a vertical plane when said motor associated with each of said actuators rotates in said first direction wherein said face shield is configured to cover the user's face, said face shield lying on a horizontal plane when said motor associated with each of said actuators rotates in said second direction wherein said face shield is configured to expose the user's face;

a pair of motion sensors, each of said motion sensors being coupled to a respective one of said actuators wherein each of said motion sensors is configured to sense motion within a trigger distance of said respective actuator, each of said actuators being actuated into said second condition when said motion sensors sense motion wherein said face shield is configured to cover the user's face when the person approaches the user, each of said actuators being actuated into said first condition when said motion sensors do not sense motion after a minimum duration of time wherein said face shield is configured to expose the user's face, each of said motion sensors being positioned on said top side of said perimeter wall of said motor housing associated with said respective actuator;

a control housing being coupled to said band, said control housing having a band slot extending laterally through said control housing, said band extending through said band slot;

a pad being coupled to said forward wall of said housing wherein said pad is configured to abut the user's head when said band is worn around the user's head, said pad being comprised of a resiliently compressible material wherein said pad is configured to enhance comfort for the user;

a control circuit being positioned in said control housing, said control circuit being electrically coupled to each of said motion sensors, said control circuit receiving a lower input and a lift input, said control circuit receiving said lower input when said motion sensors sense motion, said control circuit receiving said lift input when said motion sensors do not sense motion for a pre-determined duration of time, said control circuit being electrically coupled to said motor associated with each of said actuators, said control circuit actuating said motor associated with each of said actuators to rotate in said first direction when said control circuit receives said lower input, said control circuit actuating said motor in each of said actuators to rotate in said second direction when said control circuit receives said lift input;

a plurality of conductors, each of said conductors being integrated into said band, each of said conductors being comprised of an electrically conductive material, each of said conductors being electrically coupled between said control circuit and a respective one of said motor associated with each of said actuators and a respective one of said motion sensors;

a power switch being slidably integrated into said control housing, said power switch being electrically coupled to said control circuit, said power switch turning said control circuit on and off; and a power supply being positioned in said control housing, said power supply being electrically coupled to said control circuit, said power supply comprising at least one battery.

* * * * *